US005414495A

United States Patent [19]

DeVito et al.

[11] Patent Number: 5,414,495

[45] Date of Patent: May 9, 1995

[54] CONTROL FOR INDUCED JAM OF SELECTED ZONE OF MACHINE

[75] Inventors: Gerald M. DeVito, Ontario; Mark S. Gibson, Sodus Center, both of N.Y.

[73] Assignee: Xerox Corporation, Stamford, Conn.

[21] Appl. No.: 177,819

[22] Filed: Jan. 4, 1994

[51] Int. Cl.[6] ..... G03G 21/00

[52] U.S. Cl. ..... 355/204; 355/206; 355/316; 371/16.4

[58] Field of Search ..... 355/203–209, 355/308, 316; 271/258, 259, 263; 371/16.4, 16.5, 17, 29.1

[56] References Cited

U.S. PATENT DOCUMENTS 4,162,396 7/1979 Howard et al. ..... 355/206 X
4,297,029 10/1981 Carlson ..... 355/204 X
4,536,079 8/1985 Lippolis et al. ..... 355/206
4,554,662 11/1985 Suzuki et al. ..... 371/29.1
4,908,655 3/1990 Takagi ..... 355/209 X

*Primary Examiner*—William J. Royer
*Attorney, Agent, or Firm*—Ronald F. Chapuran

[57] ABSTRACT

A method of programming of a machine jam in an image processing apparatus by selecting a sensor associated with a desired sheet path zone by scrolling a list of sensors on a display screen, setting the control to ignore a non jam signal from the selected sensor, initiating the operation of a job run, recording a jam signal from the selected sensor and displaying selected mimics on a display, and cycling down the machine in response to the jam signal by the selected sensor.

14 Claims, 5 Drawing Sheets

CONTROL FOR INDUCED JAM OF SELECTED ZONE OF MACHINE

BACKGROUND OF THE INVENTION

The invention relates to an induced or selected jam in a machine, and, more particularly, to a programmed jam for training or diagnostics.

In using reproduction machines, there are various types of system shut downs or malfunctions that can occur in a variety of operating modes. Operator involvement in correcting malfunction such as document and paper jams can often be extensive particularly in machines with various accessories such as sorters, collators, finishers and document handlers. The problem of correcting the malfunction, maintaining the integrity of the run in process, and minimizing down time and operator involvement can be significant. Operator training and understanding of jam clearance and recovery procedures is extremely important in minimizing machine downtime. In addition, rapid and correct diagnosis of jam related malfunctions by a service representative is of paramount importance. An invaluable aid to a service representative is any technique to aid and simplify the procedure for pinpointing jam related malfunctions.

The prior art is replete with diagnostic techniques. For example, U.S. Pat. No. 4,206,995 to Legg, assigned to the same assignee as the present invention, discloses a system for moving documents in a document handler to preselected locations for inspection for proper document alignment. U.S. Pat. No. 4,335,949 to Kukucka et. al. also assigned to the same assignee as the present invention, discloses a system for successively displaying data related to the travel of documents in a document handler between sensors.

Various techniques of jam clearance exist in the prior art. For example, U.S. Pat. No. 4,627,711 to Schron, assigned to the same assignee as the present invention, discloses a control system for controlling the shutdown of a paper path system in a copy machine when a paper handling fault occurs. Upon detecting a malfunction or jam, the control system evaluates the status of all sheets in a sheet handling system and makes determinations whether to hold sheets from entering into a boundary between two zones or to drive a sheet at a boundary into a next zone.

U.S. Pat. No. 4,231,567 to Ziehm, assigned to Xerox Corporation, discloses a method and apparatus for clearing jams in a transport path of a copier. Widen a jam is sensed, in-process sheets either at a jam location or at an area upstream of the jam location are clustered while sheets downstream from the jam location are allowed to continue out into a catch tray.

U.S. Pat. No. 4,786,041 to Acquaviva et al, assigned to the same assignee as the present invention, discloses a document handler jam clearance and job recovery system. Upon the occurrence of a paper jam, the system determines whether a document has jammed in a first, second or third document path jam zone and automatically provides a preliminary job recovery operation before the document handler is fully stopped.

A deficiency in these prior art devices is the lack of selective real time jam capability to assist in operator jam recovery training or to assist in jam diagnostics.

It is an object, therefore, of the present invention to be able to selectively jam the machine or position copy sheets for operator clearance. Another object of the present invention is to be able to program various jams in a machine's paper path and document handler to illustrate proper jam clearance techniques by actual removal of a jammed sheet. Other advantages of the present invention will become apparent as the following description proceeds, and the features characterizing the invention will be pointed out with particularity in the claims annexed to and forming a part of this specification.

SUMMARY OF THE INVENTION

The present invention is a method of programming of a machine jam in an image processing apparatus by selecting a sensor associated with a desired sheet path zone by scrolling a list of sensors on a display screen, setting the control to ignore a non jam signal from the selected sensor, initiating the operation of a job run, detecting a jam signal from the selected sensor and displaying selected mimics on a display, and cycling down the machine in response to the jam signal by the selected sensor.

For a better understanding of the present invention, reference may be had to the accompanying drawings wherein the same reference numerals have been applied to like parts and wherein:

DETAILED DESCRIPTION OF THE DRAWINGS

DETAILED DESCRIPTION OF THE PREFERRED EMBODIMENT

Figure 1:
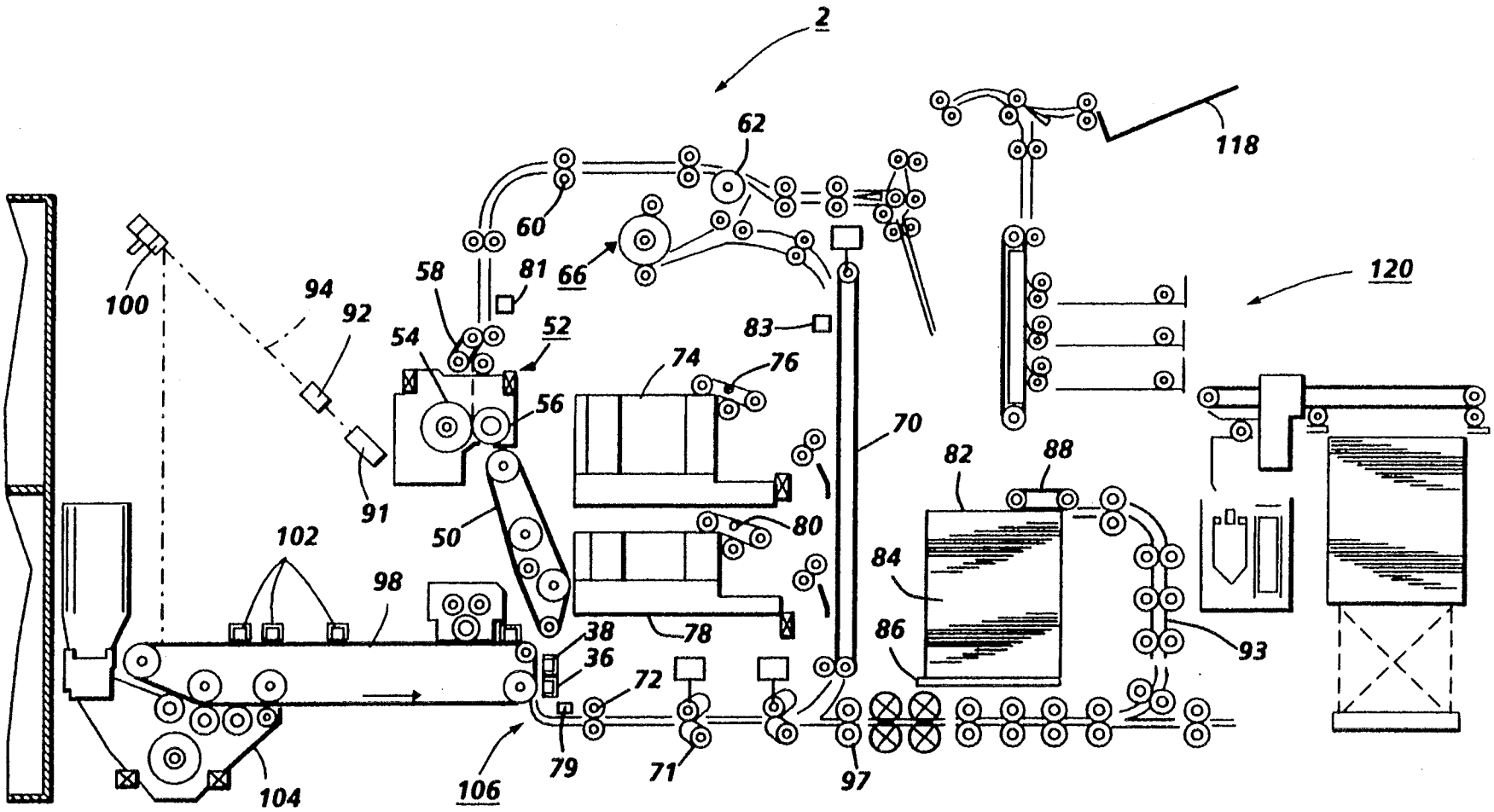
FIG. 1 is a plan view illustrating the principal mechanical components of a typical printing system incorporating the present invention.

Referring to FIG. 1, there is shown an exemplary laser based printing system 2 for processing print jobs in accordance with the teachings of the present invention. Printing system 2 for purposes of explanation is divided into a controller section and a printer section. While a specific printing system is shown and described, the present invention may be used with other types of printing systems such as ink jet, ionographic, etc.

The printer section comprises a laser type printer and for purposes of explanation is separated into a Raster Output Scanner (ROS) section, Print Module Section, Paper Supply section, and Finisher. The ROS has a laser 91, the beam of which is split into two imaging beams 94. Each beam 94 is modulated in accordance with the content of an image signal input by acousto-optic modulator 92 to provide dual imaging beams 94. Beams 94 are scanned across a moving photoreceptor 98 of the Print Module by the mirrored facets of a rotating polygon 100 to expose two image lines on photoreceptor 98 with each scan and create the latent electrostatic images represented by the image signal input to modulator 92. Photoreceptor 98 is uniformly charged by corotrons 102 at a charging station preparatory to exposure by imaging beams 94. The latent electrostatic images are developed by developer 104 and transferred at transfer station 106 to print media delivered by the Paper Supply section. Print media, as will appear, may comprise any of a variety of sheet sizes, types, and colors. For transfer, the print media or copy sheet is brought forward in timed registration with the developed image on photoreceptor 98 from either a main paper tray high capacity feeder 82 or from auxiliary or secondary paper trays 74 or 78.

A copy sheet is provided via de-skew rollers 71 and copy sheet feed rollers 72. Sensor 79 detects the absence or presence of a copy sheet leaving rollers 72. At the transfer station 106, the photoconductive belt 98 is exposed to a pre-transfer light from a lamp (not shown) to reduce the attraction between photoconductive belt and the toner powder image. Next, a corona generating device 36 charges the copy sheet to the proper magnitude and polarity so that the copy sheet is tacked to photoconductive belt and the toner powder image attracted from the photoconductive belt to the copy sheet. After transfer, corona generator 38 charges the copy sheet to the opposite polarity to detack the copy sheet from belt.

Following transfer, a conveyor 50 advances the copy sheet bearing the transferred image to the fusing station where a fuser assembly indicated generally by the reference numeral 52 permanently affixes the toner powder image to the copy sheet. Preferably, fuser assembly 52 includes a heated fuser roller 54 and a pressure roller 56 with the powder image on the copy sheet contacting fuser roller 54.

After fusing, the copy sheets are fed through a decurler 58 to remove any curl. Sensor 81 detects the absence or presence of a copy sheet leaving fuser 52. Forwarding rollers 60 then advance the sheet via duplex turn roll 62 to a gate which guides the sheet to output tray 118, finishing station 120 or to duplex inverter 66. The duplex inverter 66 provides a temporary wait station for each sheet that has been printed on one side and on which an image will be subsequently printed on the opposite side. Each sheet is held in the duplex inverter 66 face down until feed time occurs.

To complete duplex copying, the simplex sheet in the inverter 66 is fed back to the transfer station 106 via conveyor 70, de-skew rollers 71 and paper feed rollers 72 for transfer of the second toner powder image to the opposed sides of the copy sheets. Sensor 83 detects the absence or presence of a copy sheet leaving inverter 66. It should be noted that various other suitable sensors distributed throughout the copy sheet path to detect appropriate copy sheet distribution are contemplated within the scope of the present invention and sensors 79, 81, and 83 are merely illustrative. The duplex sheet is then fed through the same path as the simplex sheet to be advanced to the finishing station which includes a stitcher and a thermal binder.

Copy sheets are supplied from the secondary tray 74 by sheet feeder 76 or from secondary tray 78 by sheet feeder 80. Sheet feeders 76, 80 are friction retard feeders utilizing a feed belt and take-away rolls to advance successive copy sheets to transport 70 which advances the sheets to rolls 72 and then to the transfer station.

A high capacity feeder 82 is the primary source of copy sheets. Tray 84 of feeder 82 is supported on an elevator 86 for up and down movement and has a vacuum feed belt 88 to feed successive uppermost sheets from the stack of sheets in tray 84 to a take away drive rollers 90. Rollers 90 guide the sheet onto transport 93 which in cooperation with paper feed rollers 97 move the sheet to the transfer station via de-skew rollers 71 and feed rollers 72.

Figure 2:
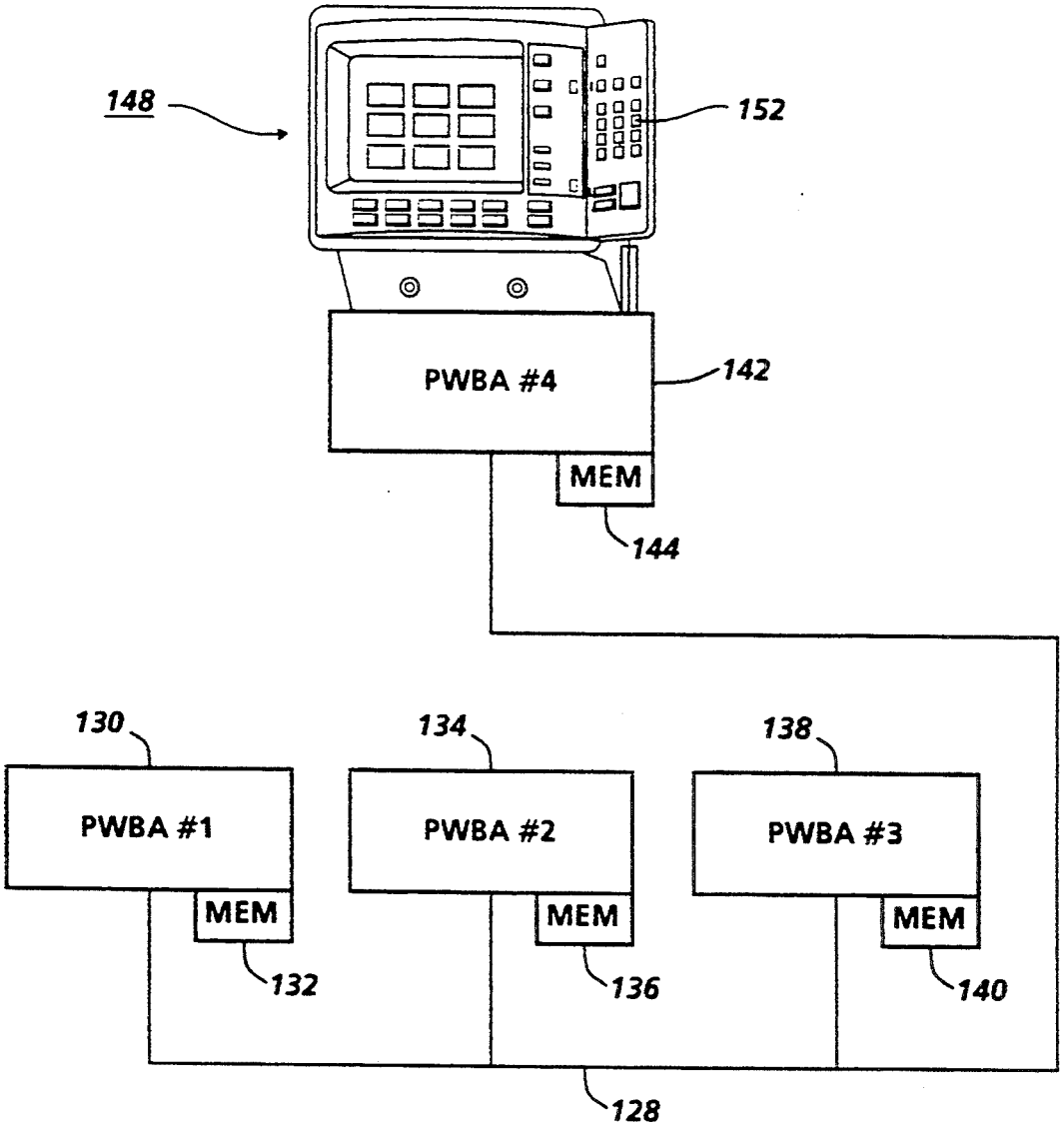
FIG. 2 is a block diagram of a typical control for use in a printing system such as disclosed in FIG. 1.

With reference to FIG. 2, there is illustrated in general block form, a typical control for the base machine 2 shown in FIG. 1. The base machine is controlled by a plurality of printed wiring boards interconnected to a common channel or bus 128. For purposes of explanation, four printed wiring boards, in particular, board 130 with memory 132, board 134 with memory 136, board 138 with memory 140, and board 142 with memory 144 are illustrated. Printed wiring board 142 is the control for the user interface 148 and the remaining printed wiring boards provides control for predetermined systems and components of the base machine 2. It should be understood that the number of printed wiring boards and the manner of interconnection is merely a design choice and any other suitable control scheme for controlling the base machine is contemplated within the scope of this invention. It should also be noted that one of the printed wiring boards, for example, board 130 could be the master control for the other printed wiring boards or that there could be any number of master slave relationships of the control boards or distributed control of the various functions of the base machine.

Figure 3:
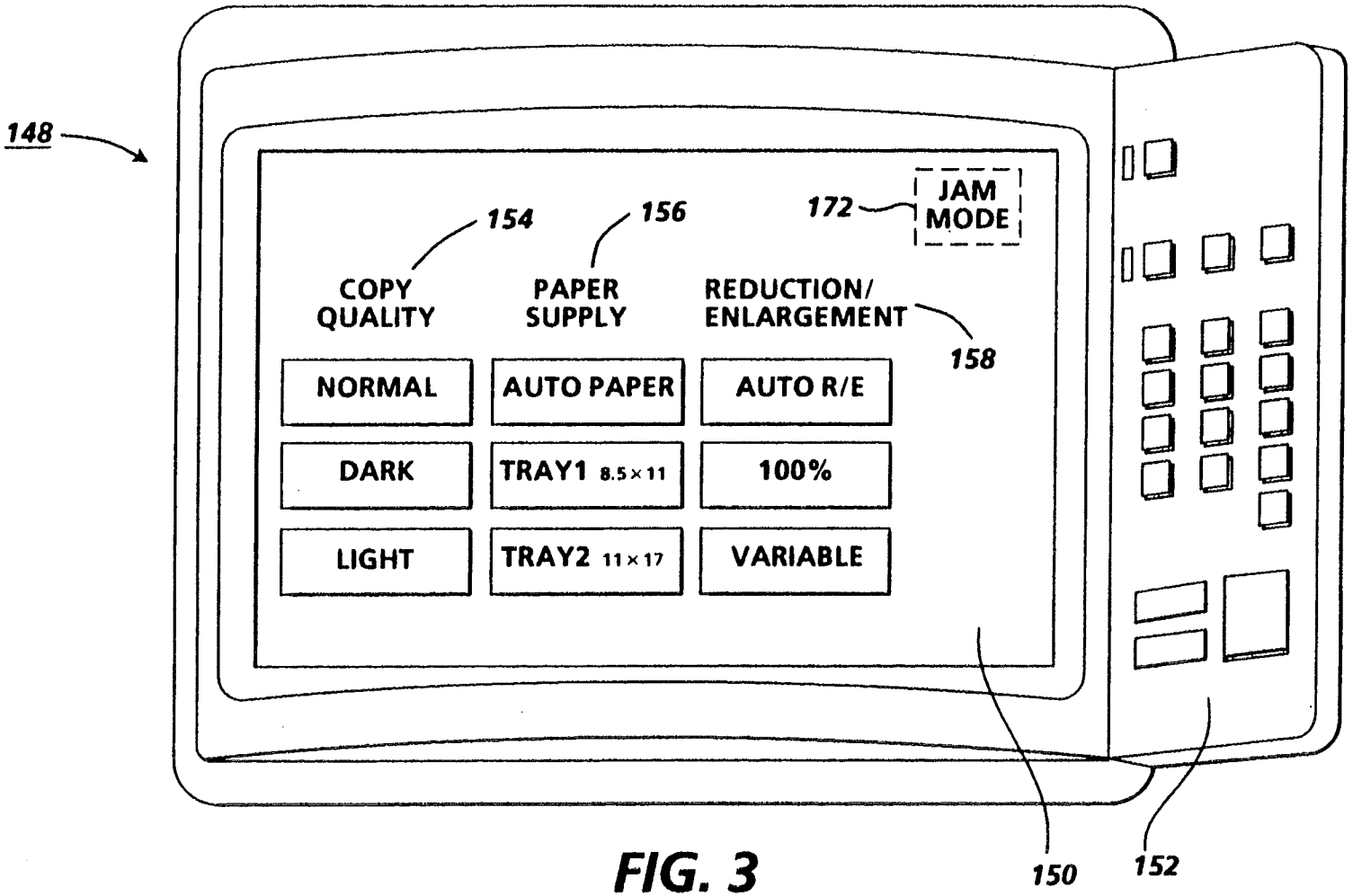
FIG. 3 illustrates an expanded view of the interface monitor screen of FIG. 2.

For purposes of understanding the present invention, it is only necessary to know that the base machine 2 has control software resident on several printed circuit boards that communicate with each other using a common network and that the base machine 2 has a user interface 148 that is controlled by software that is also part of the common network, illustrated by printed circuit board 142. FIG. 3 is merely a simplified version of the display unit 150 and hardware control panel 152 of the user interface 148 illustrating various soft control buttons such as copy quality 154 (normal, dark, and light), paper supply 156 (auto paper, tray 1, tray 2) and auto reduction/enlargement 158 including 100% and variable.

The printed circuit board 142 controlling the user interface 148 is able to monitor communications on the network 128 and display the communications on the screen 150. Each of the memories 132, 136, 140, and 144 suitably store key status, event, and fault data related to the machine for access by a service representative.

The machine operator is able to set up or program the next job or a future machine job as illustrated by the touch screen 150 in FIG. 3. That is, by suitable selection of displayed features,a job can be programmed for copy quality or a particular size paper such as tray 1 containing 8.5×11" copy sheets or tray 2 containing 11"×17" copy sheets, or to select a particular reduction/enlargement mode for example, 100% or variable.

It should be understood that the screen 150 of FIG. 3 is exemplary and that additional soft buttons can be displayed in the same frame or subsequent frames and can be selectively engaged by the operator. Also there can be a selection of suitable hard buttons shown on the panel 152 in accordance well known preprogramming techniques. For example, either hard or soft buttons can be used to select full size copies, 94% size copies, 77% size copies or any variable size copy as well as buttons to engage a recirculating document feeder to operate in a collate mode or non-collate mode. In addition, suitable buttons can enable the operator to select, in a given machine environment, finisher operations such as stapled, non-stapled, non-collated, and such features as duplex copying and offset stacking.

Figure 4:
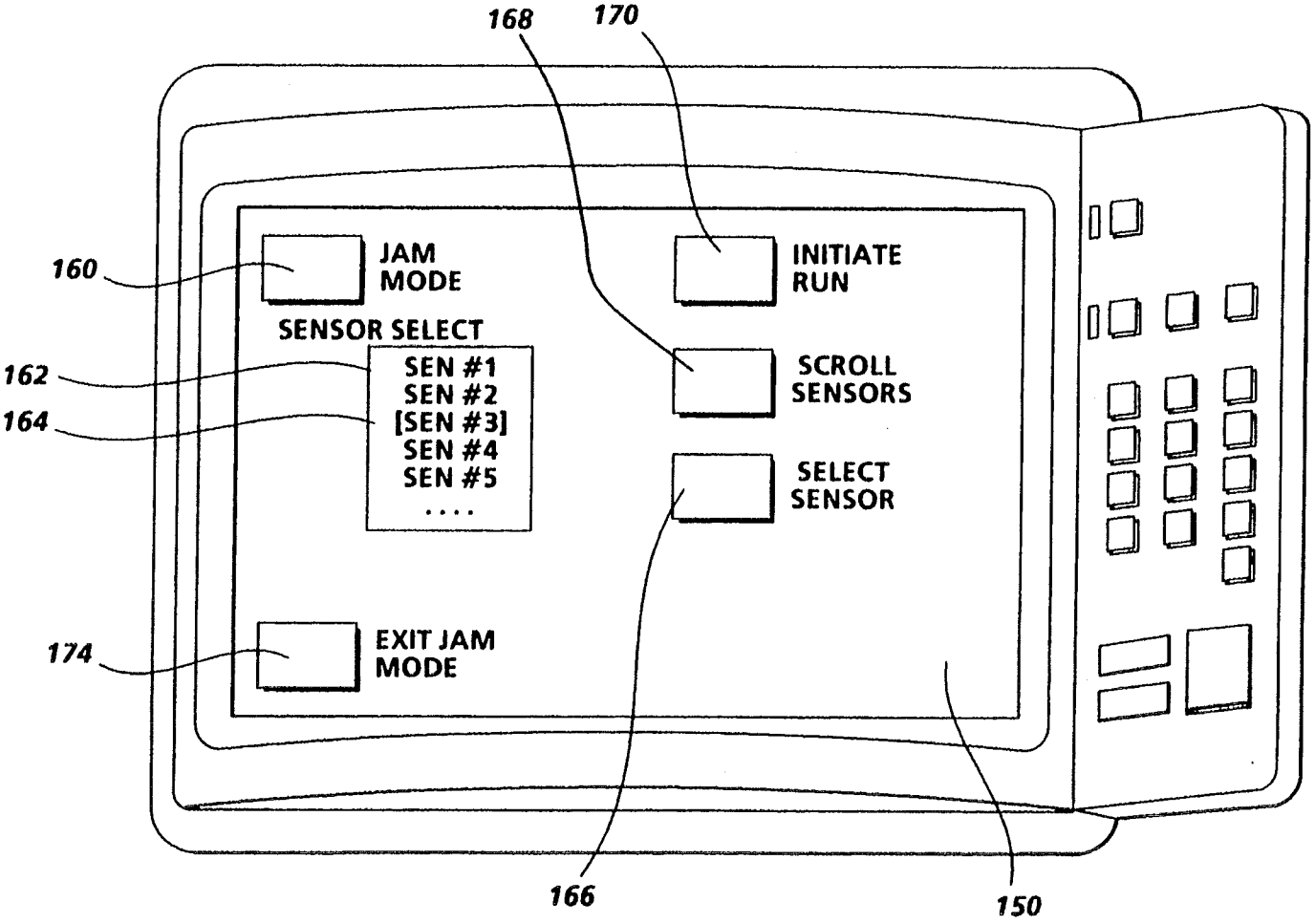
FIG. 4 illustrates the preselection of jam conditions at the interface monitor screen in accordance with the present invention.

In accordance with the present invention, with reference to FIG. 4, there is shown a typical screen display for programming or presetting a machine for selected jam conditions.

In particular, the diagnostic software of the machine control is adapted for programming or preselecting to create various jams in the machine paper path and document handler. The advantage of this capability is that predetermined or preselected paper jams can be provided in order to demonstrate for operators the proper technique for jam clearance by actually removing a jammed sheet of paper from the machine. The instructional sequence also includes the actual machine prompts and dialogue that the operator encounters upon the machine jam at the particular preselected jam location.

A typical sequence for setting the machine in a jam condition is shown with reference to FIG. 4. By activation of the button 160, the machine is put into the jam select mode in order to preselect jam locations by specifying jam sensors. Options for selecting jams are displayed in the select sensor window 162. As illustrated, five sensors SEN 1 through SEN 5 are shown in the window 162. These sensors are related to jam conditions in the machine in that a signal or a lack of a signal from any of the sensors would normally indicate that a copy sheet or document has failed to reach or pass a specific point along the copysheet path.

Sensor #3 164 is currently shown bracketed in the window 162. Upon pressing or engaging the select sensor button or switch 166, the machine control will be set up to invoke a machine paper jam as would normally happen if sensor #3 provides a jam signal. In a preferred embodiment, the control recognizes the existence of the jam mode and recognizes the selection of sensor #3. Therefore, upon return of the machine to the run condition, during normal operation and copysheet flow, the control will respond as if sensor #3 provides a jam signal.

It should be noted that although only five sensors are illustrated in the window 162, any number of slots could be provided for sensors that provide jam signals during the operation of the machine. By engaging or activating the button or switch 168 scroll sensors, each of the sensors in the window 162 can be bracketed or highlighted for selection. For example, the next activation of the scroll sensors button 168 would move the bracket from sensor #3 to sensor #4. In this case, by activation of select sensor button or switch 166, sensor #4 would be programmed or selected to provide the jam indication signal. Upon selection of the appropriate sensor, the machine is returned or put into the run mode by activation of the initiate run button 170.

Upon return to the initiate run mode, the machine can either automatically run a given or preset job or can be programmed to run a specific job at the operator console by suitable selection of program features such as illustrated FIG. 3. Also, once in the normal job run sequence, preferably a jam mode indicator is illuminated to manifest that the machine, although running, is in an induced jam mode. Such a signal is illustrated at 172 in FIG. 3. Upon initiation of the job, a signal from the selected or set switch, such as sensor #3, is not picked up or is interpreted by the control to indicate a jam. Once the machine control recognizes the existence of a jam, even though it is an induced jam, normal jam condition message will appear on the screen 150. It should be noted that various jam condition messages are known in the prior art to be provided to assist in operator jam recovery. Such messages as well as mimics or machine diagrams are used to illustrate the general location of the jam and to provide jam clearance assistance. As in a normal jam, these messages and mimics would be provided as an aid in operator training to the correct response to a specific jam. In this way, by selecting different jam sensors, an operator can be instructed and trained for the proper clearance and jam recovery for any number of jam conditions. It should also be noted that this technique is also advantageous to a service representative for diagnosing the status and response of the machine to a specific induced jam. Thus, through visual observation or through the use of message prompts, a service representative using this technique can also be assisted in diagnostics and machine maintenance.

It should be noted that preferably an exit jam mode button 174 is provided to be able to exit the jam mode. The need for an exit jam mode switch or button 174 exists only if upon completion of a job run after the initiation of run button 170, a control remains in the jam mode. As an alternative to an exit jam mode button 174, if the machine remains in the jam mode upon completion of the induced jam run, would be to provide a time out control. Such a timer after a given time period would default the control condition out of the jam mode and into the normal machine run mode. It should also be noted that although the preferred embodiment is a control that can be set to select predetermined machine jam conditions, it is within the skill of the art to preselect other malfunction conditions. In other words, it is within the skill of one in the art to provide a control in which selected conditions such as out of paper in tray 1 or out of paper in tray 2 or low toner or document with dark background conditions can be selected by an operator. The control will respond during a normal run to indicate and manifest a selected conditions as an aid to train operators for the proper response or corrective action to these or any number of machine malfunctions or to trouble shoot the machine.

Figure 5:
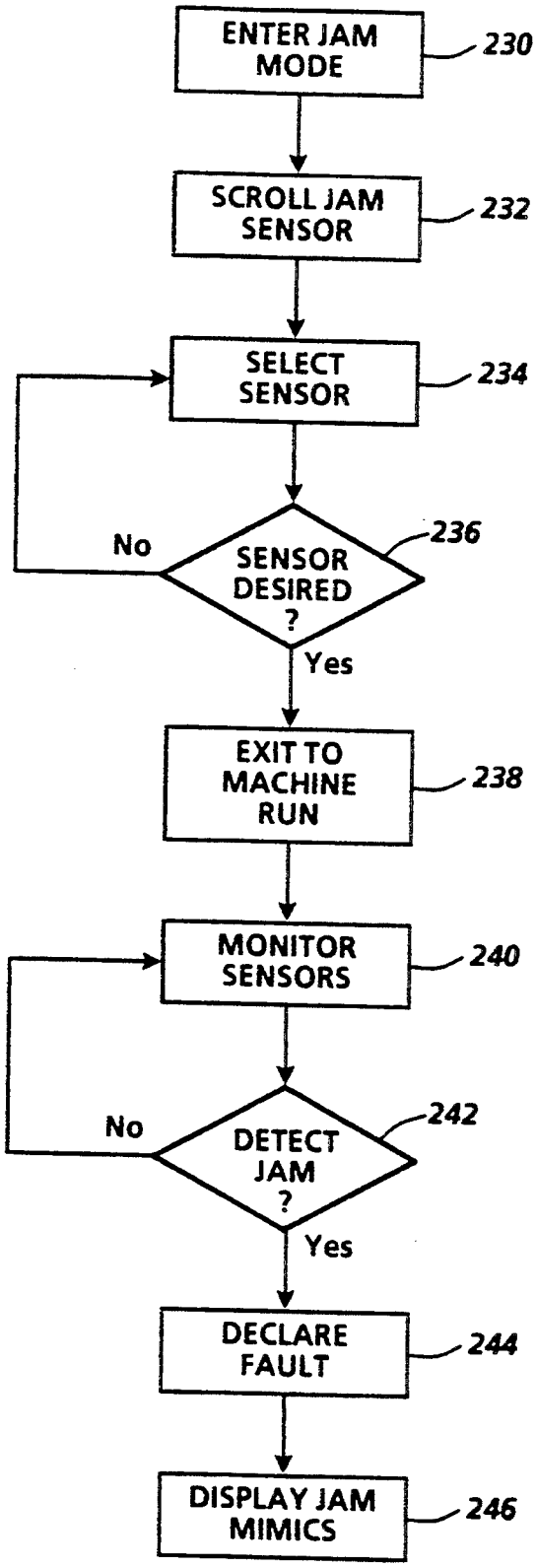
FIG. 5 is a flowchart illustrating the invoked jam procedure in accordance with the present invention.

The procedure is generally shown in the flowchart in FIG. 5. The jam mode is entered at 230, and the jam switches are scrolled at 232. Block 234 illustrates selecting a specific sensor and in that decision block 236, a determination is made if the selected sensor is the desired sensor. If not, another sensor will be selected at 234. If the desired sensor is selected the select sensor button 166 is activated and by activation of button 170 there is an exit to a machine run as shown at block 238. During machine run, there is a monitoring of all the sensors as illustrated at block 240. Upon detection of a jam as shown at decision block 242, a fault is declared as shown at 244 and a display of the appropriate messages and mimics as illustrated at block 246.

While there has been illustrated and described what is at present considered to be a preferred embodiment of the present invention, it will be appreciated that numerous changes and modifications are likely to occur to those skilled in the art, and it is intended to cover in the appended claims all those changes and modifications which fall within the true spirit and scope of the present invention.

We claim:

1. In an image processing apparatus for producing images on copy sheets, the apparatus including copy sheet sensors, a copy sheet path defined by a plurality of copy sheet zones, the sensors being associated with the copy sheet zones, a copy sheet drive, and a controller for directing the image processing apparatus, the controller tracking movement of the copy sheets along the copy sheet path by reference to the copy sheet sensors, a method of programming of a machine jam comprising the steps of:

entering the controller into a jam mode;
determining a desired copy sheet jam zone;
selecting the sensor associated with the desired copy sheet zone;
setting the controller to ignore a non jam signal from the selected sensor;
initiating operation of a job run in the image processing apparatus;
detecting a jam signal from the selected sensor; and
cycling down the imaging processing apparatus in response to the jam signal by the selected sensor.

2. The method of claim 1 wherein the step of selecting the sensor includes the step of altering a tag in memory.

3. The method of claim 1 wherein the step of selecting the sensor includes the step of scrolling a list of sensors on a display screen.

4. The method of claim 1 wherein the step of detecting a jam signal from the selected sensor includes the step of displaying selected mimics on a display.

5. The method of claim 1 including the step of automatically terminating the jam mode after a predetermined time.

6. In an image processing apparatus for producing images on copy sheets, the apparatus including copy sheet sensors, a copy sheet path defined by a plurality of copy sheet zones, the sensors being associated with the copy sheet zones, a copy sheet drive, and a controller for directing the image processing apparatus, the controller tracking movement of the copy sheets along the copy sheet path by reference to the copy sheet sensors, a method of programming of a machine jam comprising the steps of:

entering the controller into a jam mode;
determining a desired copy sheet jam zone;
selecting the sensor associated with the desired copy sheet zone by scrolling a list of sensors on a display screen and altering a tag in memory;
setting the controller to ignore a non jam signal from the selected sensor;
initiating operation of a job run in the image processing apparatus;
detecting a jam signal from the selected sensor and displaying selected mimics on a display; and
cycling down the image processing apparatus in response to the jam signal by the selected sensor.

7. The method of claim 6 including the step of automatically terminating the jam mode after a predetermined time.

8. In an image processing apparatus for producing images on copy sheets, the apparatus including copy sheet sensors, a copy sheet path defined by a plurality of copy sheet zones, the sensors being associated with the copy sheet zones, a copy sheet drive, and a controller for directing the image processing apparatus, the controller tracking movement of the copy sheets along the copy sheet path by reference to the copy sheet sensors, a method of programming of a machine jam comprising the steps of:

identifying a sensor associated with a given copy sheet zone of the plurality of copy sheet zones;
setting the controller to provoke a jam at the given copy sheet zone;
initiating operation of the image processing apparatus; and
detecting a jam signal from the identified sensor to cause a jam in one of the plurality of copy sheet zones.

9. In an image processing apparatus for producing images on copy sheets, the apparatus including copy sheet sensors, a copy sheet path, and a controller with an operator console for directing the image processing apparatus, the controller tracking movement of the copy sheets along the copy sheet path, a method of setting a predetermined machine condition related to the sensors comprising the steps of:

identifying a sensor associated with a given copy sheet;
setting the controller to induce a malfunction signal from said sensor;
initiating operation of the image processing apparatus;
detecting a malfunction signal from said sensor, and
recording the malfunction signal at the operator console to manifest a machine malfunction.

10. An image processing apparatus for producing images on copy sheets, the apparatus including copy sheet sensors, a copy sheet path, and a controller with an operator console for directing the image processing apparatus, the controller tracking movement of the copy sheets along the copy sheet path, comprising:

means to preselect a sensor associated with a given copy sheet;
logic for setting the controller to induce a malfunction signal from said sensor;
means for detecting a malfunction signal from said sensor,
means to provoke a machine malfunction in response to the detecting of the malfunction signal from said sensor, and
means for recording the malfunction signal at the operator console to manifest a machine malfunction.

11. The image processing apparatus of claim 10 wherein the controller includes a memory and means for altering a tag in memory to induce a malfunction signal from said sensor.

12. The image processing apparatus of claim 10 including means for scrolling a list of sensors on a display screen.

13. The image processing apparatus of claim 10 including means for displaying selected mimics on a display.

14. The image processing apparatus of claim 10 including means for automatically deselecting said sensor mode after a predetermined time.

* * * * *